US007253597B2

(12) United States Patent
Brokaw

(10) Patent No.: US 7,253,597 B2
(45) Date of Patent: Aug. 7, 2007

(54) CURVATURE CORRECTED BANDGAP REFERENCE CIRCUIT AND METHOD

(75) Inventor: A. Paul Brokaw, Tucson, AZ (US)

(73) Assignee: Analog Devices, Inc., Norwood, MA (US)

( * ) Notice: Subject to any disclaimer, the term of this patent is extended or adjusted under 35 U.S.C. 154(b) by 421 days.

(21) Appl. No.: 11/064,668

(22) Filed: Feb. 23, 2005

(65) Prior Publication Data

US 2005/0194957 A1 Sep. 8, 2005

Related U.S. Application Data

(60) Provisional application No. 60/550,590, filed on Mar. 4, 2004.

(51) Int. Cl.
*G05F 3/16* (2006.01)

(52) U.S. Cl. ..... 323/314; 323/316; 323/907

(58) Field of Classification Search ..... 323/313, 323/314, 315, 316, 317, 907
See application file for complete search history.

(56) References Cited

U.S. PATENT DOCUMENTS 4,588,941 A * 5/1986 Kerth et al. ..... 323/314
5,394,078 A * 2/1995 Brokaw ..... 323/313
5,666,046 A * 9/1997 Mietus ..... 323/313
5,796,244 A * 8/1998 Chen et al. ..... 323/313
5,910,726 A * 6/1999 Koifman et al. ..... 323/315
6,002,293 A * 12/1999 Brokaw ..... 327/540
6,218,822 B1 * 4/2001 MacQuigg ..... 323/313
6,225,856 B1 * 5/2001 Toth ..... 327/539
6,255,807 B1 * 7/2001 Doorenbos et al. ..... 323/314
7,112,948 B2 * 9/2006 Daly et al. ..... 323/316
7,122,997 B1 * 10/2006 Werking ..... 323/316
7,164,259 B1 * 1/2007 Megaw et al. ..... 323/313
7,166,994 B2 * 1/2007 Lee et al. ..... 323/313
2004/0124822 A1 * 7/2004 Marinca ..... 323/313
2005/0168207 A1 * 8/2005 Daly et al. ..... 323/316
2007/0052473 A1 * 3/2007 McLeod ..... 327/539

OTHER PUBLICATIONS

*A CMOS Bandgap Reference Circuit with Sub-1-V Operation*; Banba et al., IEEE Journal of Solid-State Circuits, vol. 34, No. 5, May 1999, pp. 2-6.

*Curvature-Compensated BiCMOS Bandgap with I-V Supply Voltage*, Malcovati, et al., IEEE Journal of Solid-State Circuits, vol. 36, No. 7, Jul. 2001, pp. 7-12.

* cited by examiner

*Primary Examiner*—Jeffrey Sterrett
(74) *Attorney, Agent, or Firm*—Koppel, Patrick, Heybl & Dawson

(57) ABSTRACT

A curvature corrected bandgap reference circuit comprises a first bipolar transistor having a base-emitter voltage $V_{be1}$ and operated such that it has a constant operating current, and a second bipolar transistor having a base-emitter voltage $V_{be2}$ and operated such that it has an operating current consisting of an approximately temperature proportional component and a non-linear component. The circuit is arranged such that the ratio of the current densities in the two transistors varies with temperature, such that the difference voltage ($\Delta V_{be}=V_{be1}-V_{be2}$) includes a residual component which approximately compensates bandgap curvature error.

32 Claims, 5 Drawing Sheets

CURVATURE CORRECTED BANDGAP REFERENCE CIRCUIT AND METHOD

This application claims the benefit of provisional patent application No. 60/550,590 to Brokaw, filed Mar. 4, 2004.

BACKGROUND OF THE INVENTION

1. Field of the Invention

This invention relates to the field of bandgap voltage reference circuits, and particularly to circuits and methods that compensate for the bandgap curvature term in the outputs of such circuits.

2. Description of the Related Art

Voltage reference circuits generate one or more reference voltages that are ideally stabilized over process, supply voltage, and temperature variations. Reference circuits which create an output based on the bandgap voltage of silicon largely achieve these ideals, and are one of the most popular types of voltage reference circuit.

The output of a conventional bandgap reference circuit is about 1.25 volts. This typically requires that the supply voltage for the reference circuit be no lower than 1.25 volts. However, there is an ever-increasing demand for low power and low voltage operation, which may make this limitation unacceptable.

A number of bandgap references have been proposed which overcome this supply voltage limitation. One such circuit is described in "A CMOS Bandgap Reference Circuit with Sub-1-V Operation", Banba et al., JSSC Vol. 34, No. 5, May 1999, pp 670-674. This reference circuit provides a temperature compensated reference voltage with a supply voltage of less than 1 volt. However, the output of a basic bandgap reference circuit compensates for the temperature dependencies of the output voltage only to a first order. One reason for this is that the base-emitter voltage ($V_{be}$) of a bipolar transistor does not change linearly with temperature. This nonlinearity results in a "bandgap curvature" error in the output voltage which varies over temperature. The circuit described in Banba does not address this error, and as such, its reference voltage output may not be adequate for some applications.

Various approaches to compensate for the nonlinearity of $V_{be}$ have been proposed. One such approach is described in "Curvature-Compensated BiCMOS Bandgap with 1-V Supply Voltage", Malcovati et al., JSSC Vol. 36, No 7, May 1999, pp 1076-1081. Here, additional transistors and resistors are added to the reference circuit to provide curvature compensation. However, the additional components have relatively large values and require relatively large areas, adding cost and complexity to the design.

SUMMARY OF THE INVENTION

A curvature corrected bandgap reference circuit and method are presented, which provide a curvature compensated reference voltage with a low overhead voltage and a small total resistance.

The present reference circuit comprises a first bipolar transistor having a base-emitter voltage $V_{be1}$ and operated such that it has a constant operating current, and a second bipolar transistor having a base-emitter voltage $V_{be2}$ and operated such that it has an operating current consisting of an approximately temperature proportional component and a non-linear component. The circuit is arranged such that the ratio of the current densities in the first and second bipolar transistors varies with temperature such that the difference voltage $\Delta V_{be}=V_{be1}-V_{be2}$ includes a residual component which approximately compensates bandgap curvature error.

In one embodiment, first and second bipolar transistors (Q1 and Q2)—which can be CMOS— parasitic substrate transistors—have their respective bases and collectors connected to first and second circuit common points, respectively. First and second current sources provide currents I1 and I2 to first and second nodes, respectively. The emitter of Q1 is coupled to the first node. A resistor R1 is connected between the second node and a third node, a resistor R2 is connected between the third node and the emitter of Q2, and a resistor R3 is connected between the second node and a reference potential. A differential amplifier is connected to the first and second nodes at its inputs, and its output is arranged to control the first and second current sources such that the voltages at the first and second nodes are equal and I1 and I2 are maintained in a fixed ratio.

The circuit is arranged such that I1 and I2 are substantially temperature invariant when the voltages at the first and second nodes are equal, such that the signal across R2 includes a temperature proportional component and a residual component, wherein the residual component is of the form:

$$(kT/q)\ln((T_0-T_x)/(T-T_x)),$$

where $T_0$ is a normalizing measurement temperature and $T_x$ is the zero intercept of the temperature proportional component. The circuit is arranged such that this residual component compensates bandgap curvature error.

Several variants are described, including an embodiment which employs at least one current source that can be selectively connected to the first node to adjust current I1 and thereby trim the ratio of I1 to I2.

Further features and advantages of the invention will be apparent to those skilled in the art from the following detailed description, taken together with the accompanying drawings.

DETAILED DESCRIPTION OF THE INVENTION

The present curvature corrected bandgap reference circuit requires operating a first bipolar transistor (Q1) having a base-emitter voltage $V_{be1}$ such that it has a constant operating current, and operating a second bipolar transistor (Q2) having a base-emitter voltage $V_{be2}$ such that it has an operating current consisting of an approximately temperature proportional component and a non-linear component. This results in a ratio of current densities in Q1 and Q2 which varies with temperature. When properly arranged, the difference voltage $\Delta V_{be}=V_{be1}-V_{be2}$ will include a residual component of the form:

$$(kT/q)\ln((T_0-T_x)/(T-T_x)),$$

where $T_0$ is a normalizing measurement temperature and $T_x$ is the zero intercept of the temperature proportional component; this residual component can be used to approximately compensate bandgap curvature error.

Figure 1:
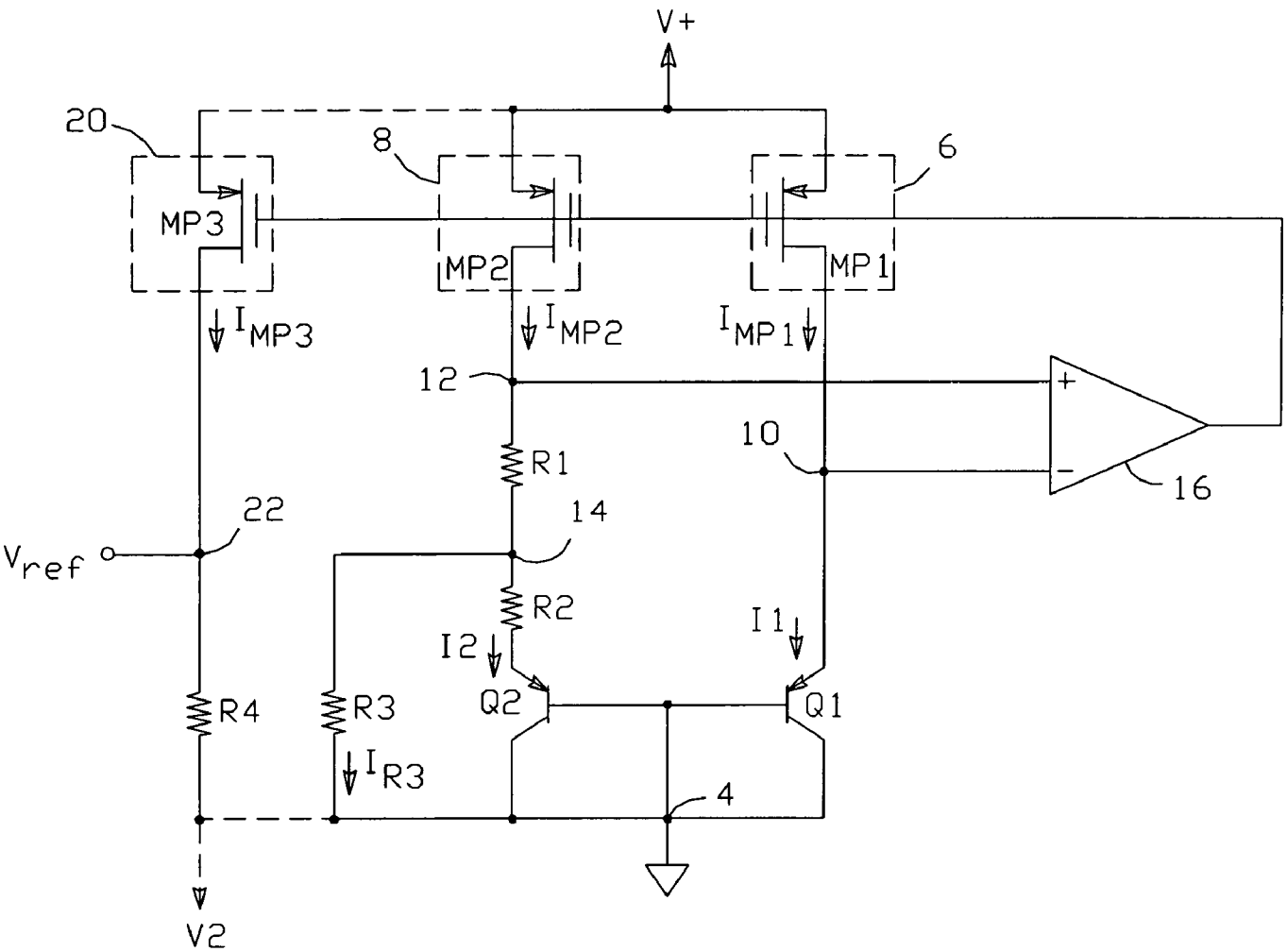
FIG. 1 is a schematic diagram of a basic embodiment of a bandgap reference circuit per the present invention.
Figure 3:
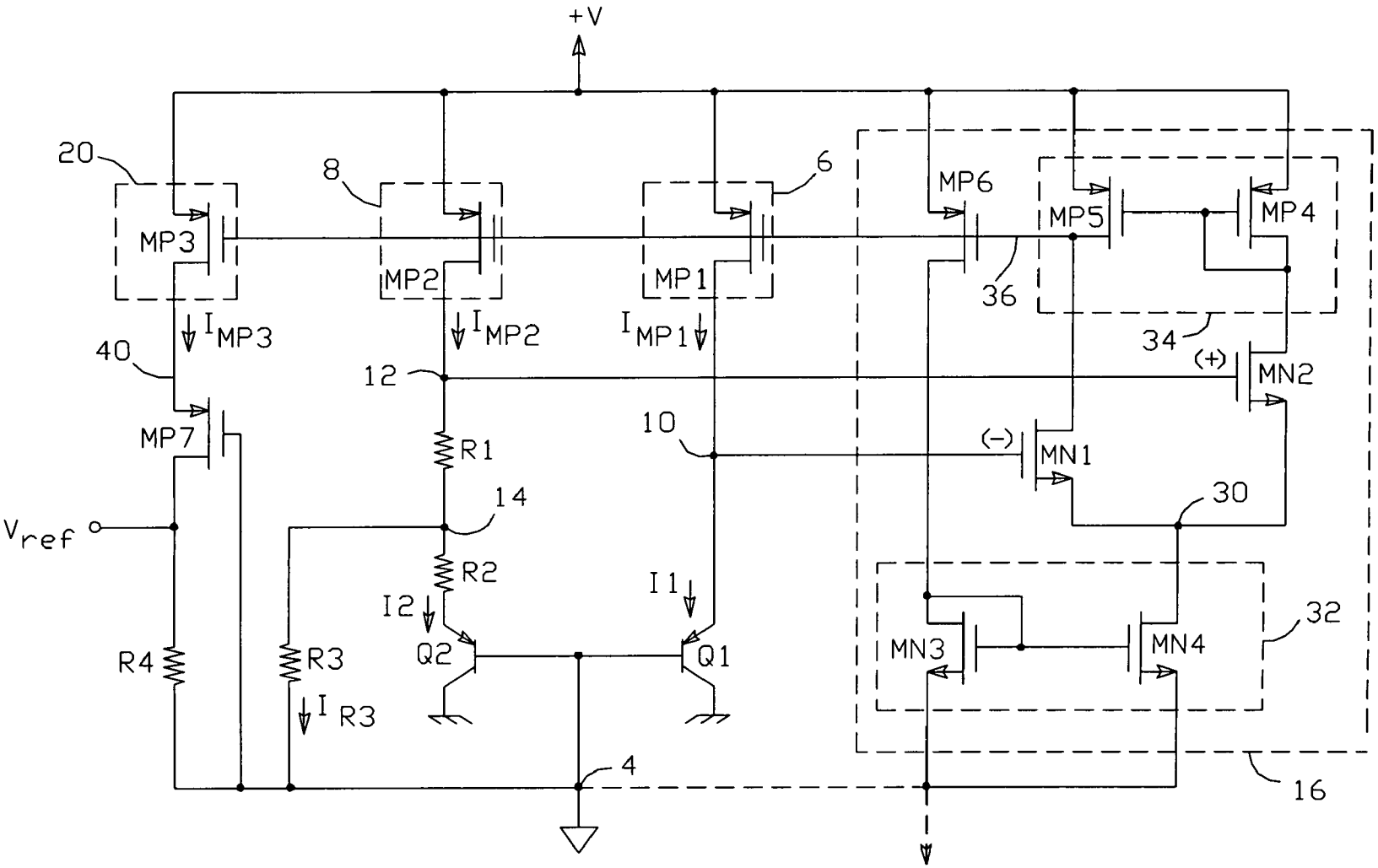
FIG. 3 is a schematic diagram of another possible embodiment of a bandgap reference circuit per the present invention.
Figure 4:
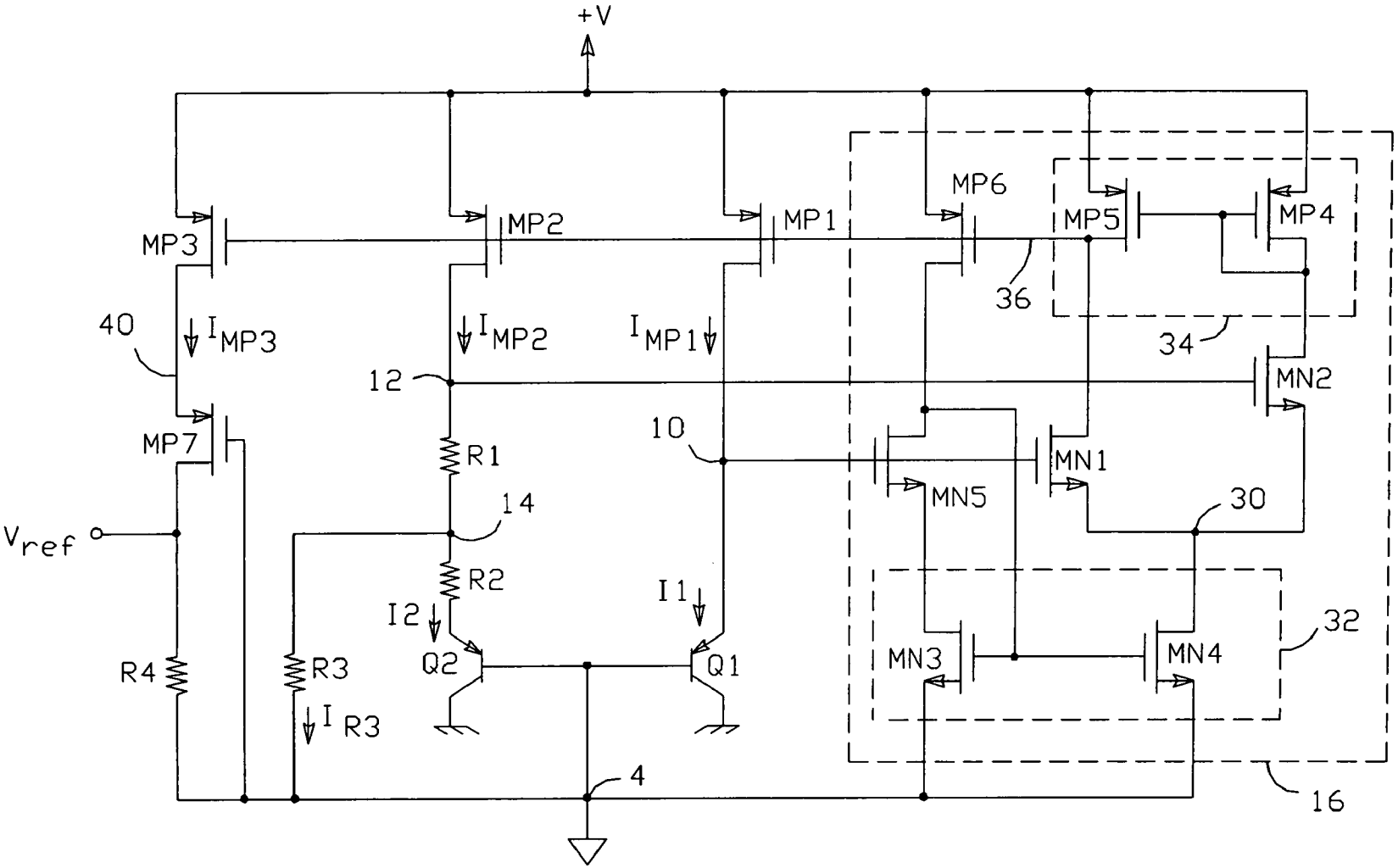
FIG. 4 is a schematic diagram of another possible embodiment of a bandgap reference circuit per the present invention.

One possible circuit-embodiment which implements this approach is shown in FIG. 1. The circuit includes first and second bipolar transistors (Q1, Q2) having their bases coupled to a circuit common point 4, first and second current sources (6,8) connected to a supply voltage V+ and arranged to provide first and second currents $I_{MP1}$ and $I_{MP2}$, respectively, and first and second nodes (10,12) which receive $I_{MP1}$ and $I_{MP2}$, respectively. The collectors of Q1 and Q2 can also be connected to circuit common point 4, or may alternatively be connected to a different common point, such as the substrate of an IC fabricated with a CMOS process (as illustrated in FIGS. 3 and 4, below). The emitter of Q1 is coupled to node 10. A resistor R1 is connected between node 12 and a third node 14, a resistor R2 is connected between node 14 and the emitter of Q2, and a resistor R3 is connected between node 14 and circuit common point 4.

A differential amplifier 16 is connected to nodes 10 and 12 at its inputs, and its output controls current sources 6 and 8 such that the voltages at nodes 10 and 12 are equal and I1 and I2 are maintained in a fixed ratio. As described in more detail below, the circuit is arranged such that $I_{MP1}$ and $I_{MP2}$ are substantially temperature invariant when the voltages at nodes 10 and 12 are equal, such that the signal across R2 includes a temperature proportional component and a residual component. This residual component is of the form:

$$(kT/q)\ln((T_0-T_x)/(T-T_x)),$$

where $T_0$ is a normalizing measurement temperature and $T_x$ is the zero intercept of the temperature proportional component. When the resistor ratios are properly set, the residual component substantially compensates the base-emitter voltage ($V_{be}$) curvature term present in the current in R3.

To generate a reference voltage output, the reference circuit can include a third current source 20 arranged to track currents $I_{MP1}$ and $I_{MP2}$ and provide a third current $I_{MP3}$ to a fourth node 22. A load resistor R4 is connected between node 22 and a reference point 23, with the voltage developed at node 22 being the reference circuit's output voltage $V_{ref}$. The reference point 23 to which R4 returns could be circuit common point 4; alternatively, R4 could return to an entirely different reference potential (V2), with $V_{ref}$ developed with respect to that potential. When the $V_{be}$ voltage curvature term present in the R3 current is compensated as described above, the accuracy of reference voltage $V_{ref}$ is substantially improved.

Bipolar transistors Q1 and Q2 are suitably CMOS parasitic substrate transistors, though conventional bipolar transistors can also be used. The emitter area of Q2 is preferably—though not necessarily—larger than that of Q1. When the present reference circuit is fabricated as part of a CMOS circuit, current sources 6 and 8 are preferably implemented with PMOS FETs MP1 and MP2, respectively. The ratio between the currents $I_{MP1}$ and $I_{MP2}$ provided by MP1 and MP2 is fixed by their relative widths; MP1 is preferably made larger than MP2, though this is not essential. Amplifier 16 drives the common gate of MP1 and MP2. Increasing the matched currents increases the voltages at nodes 10 and 12. The relative impedance at these nodes is different and so the voltage difference between nodes 12 and 10 changes with the common mode voltage. Amplifier 16 is connected to drive nodes 10 and 12 until they are at equal voltages, and will stabilize the operating point at this condition independently of temperature.

In prior art circuits similarly arranged, but without R3, the resulting $I_{MP1}$ and $I_{MP2}$ currents would be proportional-to-absolute-temperature (PTAT), since Q1 and Q2 would operate at an invariant current density ratio. However, adding R3 at node 14 without a corresponding load on the emitter of Q1 emitter causes Q2 and Q1 to operate at a current density ratio which changes with temperature; the current density in Q1 is preferably higher than that in Q2. The current from MP2 divides at node 14, with some going to Q2 via R2, and the rest going to circuit common via R3. The voltage at node 14 differs by only a fixed amount from the $V_{be}$ of Q1 ($V_{be1}$), so that as temperature rises and the voltages at nodes 10 and 14 fall, the current in R3 will decrease.

As the current in R3 falls, the current from MP2 must either fall by the same amount, or the difference—which will increase with temperature—will flow through R2 to Q2. If the MP2 current is made temperature invariant, then the current in R2 must increase in proportion to temperature, though not necessarily in proportion to absolute temperature; as is well known, $V_{be}$ does not fall perfectly linearly with temperature, but rather has a small additional component of non-linear behavior that manifests as curvature of the output voltage over temperature in uncompensated bandgaps.

The present invention causes the current in R2 to be largely temperature proportional, but with a small non-linear addition that can be used to compensate the curvature of current in R3 over temperature. The result is that the operating point stabilized by the amplifier will occur when the currents in all top branches (i.e., $I_{MP1}$ and $I_{MP2}$ in the exemplary embodiment shown in FIG. 1) are approximately temperature invariant.

For the analysis below, it is initially assumed that currents $I_{MP1}$ and $I_{MP2}$ are temperature invariant; this is then shown to be correct. "N1" and "N2" are the emitter areas of Q1 and Q2, respectively. A reference temperature "$T_0$" is invoked at which the circuit may be examined. Since the currents are assumed to be temperature invariant, the current in Q1 is referred to as $I1_0$ (i.e., I1 at $T_0$, which is, in fact, the same at all temperatures.) However, the current in Q2 changes with temperature, so-is-referred to as I2 at temperatures other than $T_0$, and $I2_0$ whenever Q2 is at $T_0$.

At any temperature in the operating range, the actual difference in the $V_{be}$'s of Q1 and Q2 ($\Delta V_{be}=V_{be1}-V_{be2}$) is given by the following relation to their actual current density ratio:

$$\Delta V_{be}=(kT/q)\ln((I1_0*N2)/(I2*N1)) \quad (1)$$

where $I1_0$/N1 is the current density in Q1 and I2/N2 is the current density in Q2. In a conventional bandgap reference circuit, the current density ratio is kept constant, but here the circuit is arranged so that the ratio varies with temperature as I2 changes with temperature. Thus, both the (kT/q) and the $\ln((I1_0*N2)/(I2*N1))$ factors vary with temperature.

Since the voltage across R3 is approximately complementary-to-absolute-temperature (CTAT), the current in Q2 should be temperature proportional, though not necessarily PTAT, and should be of the form:

$$I2=I2_0(T-T_x)/(T_0-T_x),$$

where $T_x$ is the zero intercept of the temperature proportional voltage across R2. Thus, I2 is proportional to T, falling linearly from $I2_0$ at $T=T_0$ to zero at $T=T_x$.

Substituting the I2 expression into equation (1) provides:

$$\Delta V_{be}=(kT/q)\ln((I1_0*N2)/(I2_0((T-T_x)/(T_0-T_x))N1)$$

Rearranging:

$$\Delta V_{be}=(kT/q)\ln(((T_0-T_x)/(T-T_x))(I1_0*N2)/(I2_0*N1))$$

Invoking logarithmic identity:

$$\Delta V_{be}=(kT/q)\ln((T_0-T_x)/(T-T_x))+(kT/q)\ln((I1_0*N2)/(I2_0*N1)) \quad (2)$$

The first term of this result is a in of a reciprocal T function, which has a curvature opposite to that of $\ln(T_0/T)$, at least for $T_x$ in the range of about 170 degrees Kelvin (outside the temperature range at which the circuit is operated).

A base-emitter voltage $V_{be}$ can be expressed as a function of temperature and current in terms of its value $V_{be0}$ at $T_0$ by the well known relationship:

$$V_{be}=V_{G0}+(T/T_0)(V_{be0}-VGO)+(kT/q)\ln(I/I_0)+(mkT/q)\ln(T_0/T) \quad (3)$$

where $V_{G0}$ is the bandgap voltage of silicon extrapolated to 0 degrees Kelvin. The term $(mkT/q)\ln(T_0/T)$ is the bandgap curvature, and causes simple bandgaps to have a non-linear error over temperature. This is the error that the invention compensates.

The current in R3 ($I_{R3}$) is determined by $V_{be1}$−V1, where V1 is the presumed invariant voltage across R1. Thus, $I_{R3}$ is given by:

$$I_{R3}=(V\ GO+(T/T_0)\ (V_{be10}-VGO)+(kT/q)\ln(I1/I1_0)+(mkT/q)\ln(T_0/T)-V1)/R3$$

where $V_{be10}$ is $V_{be1}$ at $T_0$. Since I1 is presumed to be always equal to $I1_0$, the $(kT/q)\ln(I1/I1_0)$ term drops out and:

$$I_{R3}=(VGO+(T/T_0)(V_{be10-V}GO)+(mkT/q)\ln(T_0/T)-V1)/R3$$

The current in Q2 and R2 is determined by V1 and $\Delta V_{be}$ as expressed in (2) by:

$$I2=((kT/q)\ln((T_0-T_x)/(T-T_x))+(kT/q)\ln((I1_0*N2)/(I2_0*N1))-V1)/R2$$

The term $(kT/q)\ln((I1_0*N2)/(I2_0*N1))$ is PTAT since it is based only on the ratio of the current densities at $T_0$. But, when V1 is subtracted from it, the temperature at which the combination goes to zero is shifted to a temperature greater than zero degrees Kelvin. This shift is to the temperature $T_x$. If the $(kT/q)\ \ln((T_0-T_x)/(T-T_x))$ expression is neglected, then I2 extrapolates to zero at this temperature. Near $T_x$, $\ln((T_0-T_x)/(T-T_x))$ becomes large, but $T_x$ is made to be so far below the operating range that $(kT/q)\ln((T_0-T_x)/(T-T_x))$ will remain small.

This means that the voltage across R2 consists of a temperature proportional part, which is complemented by the linear portion of $V_{be}$, and an additional logarithmic part that adds a non-linear component to I2. The non-linear portion of the current in R2 can be sized by choosing V1 and the value of R2 relative to R3, so that the nonlinearity approximately compensates the nonlinearity of the current in R3 due to the curvature of $V_{be}$.

Figure 2:
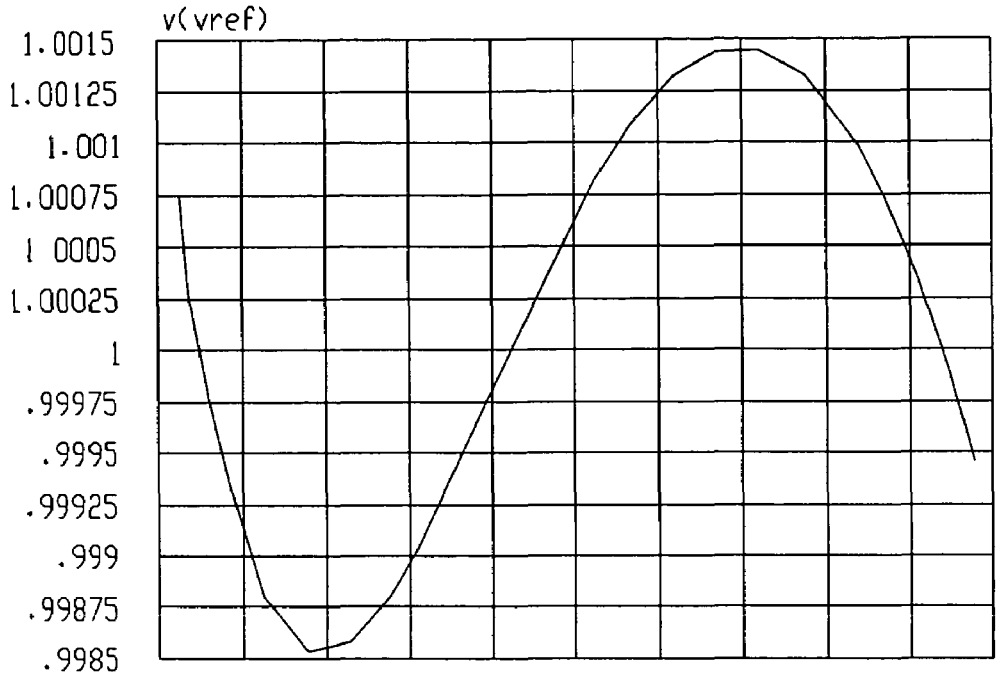
FIG. 2 is a graph resulting from a circuit simulation, showing the curvature components of various currents in a reference circuit per the present invention (lower plot), and the reference voltage output over a wide temperature range (upper plot).
Figure 2:
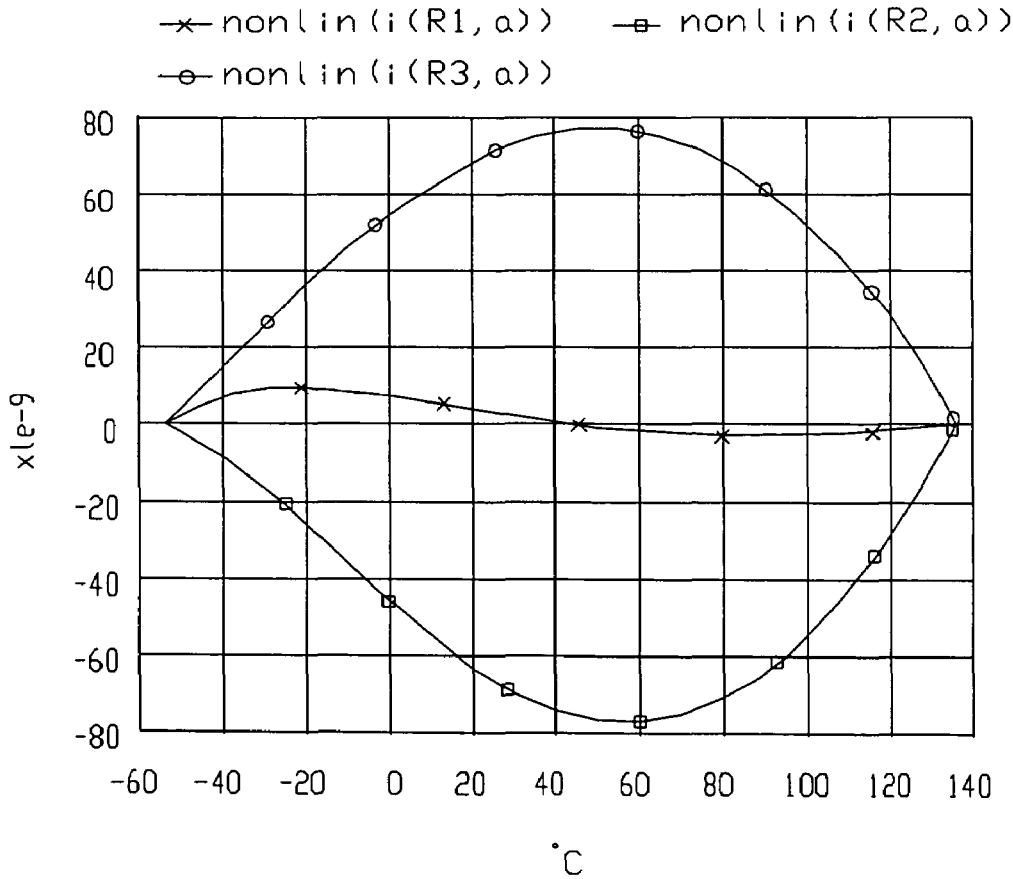

Results obtained by the invention are illustrated with the circuit simulation plots shown in FIG. 2. The lower plot shows the curvature components of the current: in R3 due to $V_{be}$ (upper trace); in R2 due to the nonlinearity introduced into $\Delta V_{be}$ (lower trace); and the resultant in R1 (center trace). The R3 curvature is what would be present in an uncorrected reference, while the R1 current shows the residual after correction by the method of the invention. The curves show a reduction of between seven and eight to one in the curvature, which is the largest of the errors in an uncompensated bandgap.

The upper plot in FIG. 2 shows the resulting simulated output voltage $V_{ref}$ over a wide temperature range. This voltage is obtained by making an image of the invariant currents in MP1 and MP2, preferably by making third current source 20 with a FET MP3 and driving load resistor R4 with current $I_{MP3}$.

The circuit can be simply realized using only the parasitic bipolar transistors available in CMOS processes. The present invention requires fewer resistors and less total resistance than prior art approaches, thereby reducing IC cost.

When arranged as shown, reference voltage output $V_{ref}$ can be set as needed by selecting the resistance of R4, and can thus be smaller than the extrapolated bandgap voltage (−1.2 volts). The circuit's supply voltage can be less than that required for a conventional bandgap: at the lowest planned operating temperature, the supply must exceed $V_{be}$ by enough voltage to enable MP1 and MP2 to operate. If M1 and M2 are sized so as to require only a small difference in source-to-drain voltage for operation, the supply voltage need only be as large as $V_{be1}$ plus this small difference, rather than being limited by the extrapolated bandgap voltage. When employing this minimum supply voltage, other transistors driven by the output of amplifier 16 (such as MP3) must be properly proportioned to MP1 and MP2, and amplifier 16 must also be designed to operate within this supply voltage.

The temperature intercept point $T_x$ can be set by adjustment of V1. By so doing, the shape and proportion of the compensating voltage can be adjusted to fit the curvature component of $V_{be}$, and that due to the temperature coefficients of the circuit's resistors if necessary.

FIG. 3 shows another possible embodiment of the invention. Here, bipolar transistors Q1 and Q2 are CMOS parasitic substrate transistors. As mentioned above, in this embodiment, the bases of Q1 and Q2 are connected to first circuit common point 4, while the collectors of Q1 and Q2 are connected to a different circuit common point—here, the CMOS substrate. In this exemplary embodiment, differential amplifier 16 comprises first and second NMOS FETs MN1 and MN2 having their gates connected to nodes 10 and 12, respectively, and their sources connected together at a node 30. Tail current is provided by a current mirror 32 suitably comprised of NMOS FETs MN3 (diode-connected) and MN4, connected to mirror an input current provided to the drain/gate of MN3 to node 30. A current mirror 34 comprising PMOS FETs MP4 (diode-connected) and MP5 is connected to the drains of MN2 and MN1, respectively, to provide an active load which provides the amplifier's output 36. An image of the output current is used to generate the amplifier's tail current; this is done by driving a PMOS FET MP6 with amplifier output 36 to provide the input current to current mirror 32. Tail current mirror 32 can be referred to circuit common point 4, or alternatively, to a different reference potential (V3)—as might be done to provide more headroom for mirror 32. For example, if the sources of MN3 and MN4 are connected to V3, and circuit common point 4 is made more positive than V3, the relative voltage at node 30 will go up—thereby providing more headroom. This might be particularly desirable if the threshold voltages of MN1 and MN2 were comparable to $V_{be}$.

A PMOS FET MP7 may be interposed between current source 20 and load resistor R4 to provide a cascode function. As illustrated in FIG. 3, MP7's gate is connected to circuit common, its source to current source 20 at a node 40, and its drain to R4 and output terminal $V_{ref}$, such that MP7 conducts 13 to R4. Adding MP7 causes the voltage at node 40 to have a temperature coefficient similar to that of nodes 10 and 12, which serves to help MP3 track MP2 and MP1 so that the current in MP3 and therefore $V_{ref}$ is further stabilized over temperature.

When amplifier 16 is biased with a current proportional to temperature invariant currents $I_{MP1}$ and $I_{MP2}$, as shown in FIGS. 3 and 4, the amplifier's operating current will also be temperature invariant. As such, the entire reference circuit will, in addition to making a constant output voltage, draw a constant bias current—and thus could be used as a series element (with or without MP3 and R4) to generate a constant current.

Another possible embodiment is shown in FIG. 4, which illustrates an enhancement to amplifier 16. An NMOS FET MN5 is interposed between MP6 and current mirror 32, with its gate connected to node 10, its drain connected to the drain of MP6 and to the gate of MN3, and its source connected to the drain of MN3. When so arranged, MN5—preferably sized the same as MN1—sets the drain voltage of MN3 about equal to that of MN4. The drain of MN5 drives the common gate of MN3 and MN4, and will rise until MN3 accepts the current from MP6. Since MN3 and MN4 have a common gate voltage, and are driven to have equal drain voltages, their currents should accurately reflect the current supplied to MN3 from MP6 by way of MN5.

Figure 5:
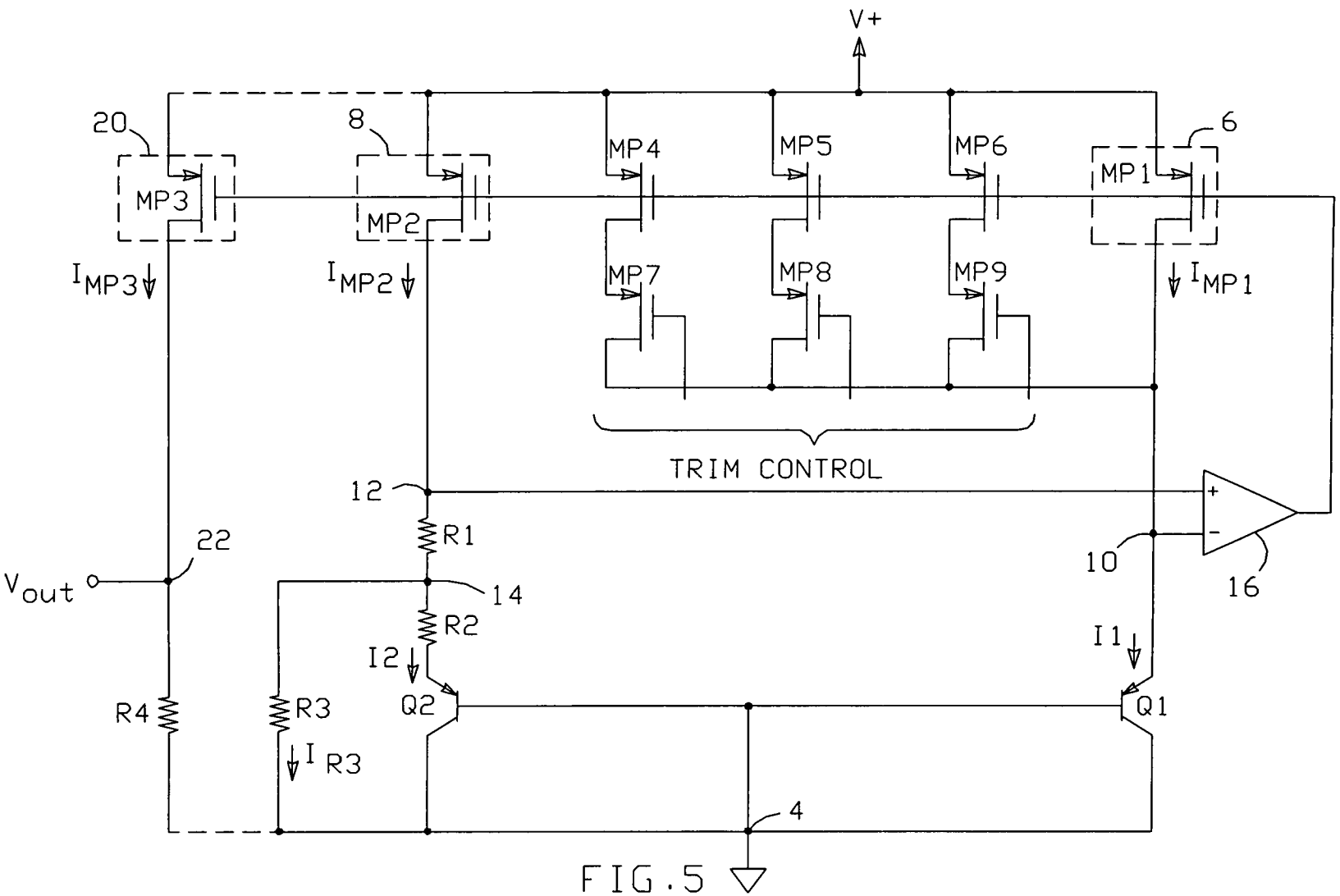
FIG. 5 is a schematic diagram of another possible embodiment of a bandgap reference circuit per the present invention.

Another embodiment is shown in FIG. 5, which includes a trim capability, which enables the circuit to be corrected for variability in the manufacturing process and to bring all like units to the same output voltage. Here, the circuit includes at least one switchable current source which can be selectively connected to node 10 to adjust current I1 and thereby trim the ratio of I1 to I2. As implemented in FIG. 5, each switchable current source includes a current source FET (MP4, MP5, MP6) having its gate connected to the output of amplifier 16, and its source-drain circuit connected between the supply voltage and a switch, preferably implemented with respective switching FETs (MP7, MP8, MP9). The switches are operated with a "trim control" word, which selectively connects one or more of the current source FETs to node 10. The current source FETs can be sized as desired, to provide, for example, equal currents or binary-weighted currents.

As with most self-biased circuits, the circuit arrangements described herein require starting. This can be accomplished in many different ways. For example, a FET can be connected between the common gates of MP1 and MP2 and node 10. Turning on this FET starts the biasing, and the circuit comes on regeneratively. The FET is then turned off when the circuit reaches a steady state ON condition, so as not to disturb normal operation.

The circuit embodiments shown in FIGS. 1 and 3-5 are merely exemplary. The functionality of the invention could be provided with many different circuit arrangements. It is only essential that a first bipolar transistor be operated such that it has a constant operating current, and a second bipolar transistor be operated such that it has an operating current consisting of an approximately temperature proportional component and a non-linear component, such that the ratio of the current densities in the first and second bipolar transistors varies with temperature and the difference voltage ($\Delta V_{be}$) includes a component which approximately compensates bandgap curvature error.

While particular embodiments of the invention have been shown and described, numerous variations and alternate embodiments will occur to those skilled in the art. Accordingly, it is intended that the invention be limited only in terms of the appended claims.

I claim:

1. A curvature corrected bandgap reference circuit, comprising:

first and second bipolar transistors having their bases and collectors coupled to first and second circuit common points, respectively;

first and second current sources arranged to provide first and second currents I1 and I2, respectively;

first and second nodes which receive said first and second currents, respectively, the emitter of said first bipolar transistor coupled to said first node;

a differential amplifier connected to said first and second nodes at its inputs, the output of which is arranged to control said first and second current sources such that the voltages at said first and second nodes are equal and said first and second currents are maintained in a fixed ratio;

a first resistor connected between said second node and a third node;

a second resistor connected between said third node and the emitter of said second bipolar transistor;

a third resistor connected between said second node and said first circuit common point;

said circuit arranged such that said first and second currents are substantially temperature invariant when the voltages at said first and second nodes are equal such that the signal across said second resistor includes a temperature proportional component and a residual component, wherein said residual component is of the form:

$$(kT/q)\ln((T_0-T_x)/(T-T_x)),$$

where $T_0$ is a normalizing measurement temperature and $T_x$ is the zero intercept of said temperature proportional component.

2. The reference circuit of claim 1, wherein said circuit is arranged such that said residual component substantially compensates the base-emitter voltage curvature term present in the current in said third resistor.

3. The reference circuit of claim 1, wherein said circuit is arranged such that the current density in said first bipolar transistor is higher than that in said second bipolar transistor.

4. The reference circuit of claim 3, wherein said circuit is arranged such that the ratio of the current densities in said first and second bipolar transistors varies with temperature.

5. The reference circuit of claim 1, wherein the emitter area of said second transistor is larger than the emitter area of said first transistor.

6. The reference circuit of claim 1, wherein said first and second bipolar transistors are CMOS parasitic substrate bi-polar transistors.

7. The reference circuit of claim 1, wherein said first and second current sources comprise respective transistors having their control inputs connected to the output of said differential amplifier and their current circuits connected between a supply voltage and said first and second nodes, respectively.

8. The reference circuit of claim 7, further comprising:

a third current source arranged to provide a third current I3 which tracks currents said first and second currents;

a fourth node which receives said third current; and a load resistor connected between said fourth node and a reference potential, the voltage developed at said fourth node being said reference circuit's output voltage.

9. The reference circuit of claim 8, wherein said reference potential is the potential at said first circuit common point.

10. The reference circuit of claim 8, wherein said reference potential is different from the potential at said first circuit common point.

11. The reference circuit of claim 8, wherein said third current source comprises a transistor having its control input connected to the output of said differential amplifier and its current circuit connected between said supply voltage and said fourth node.

12. The reference circuit of claim 11, further comprising a transistor having its control input connected to said first circuit common point and its current circuit interposed between the output of said third current source and said fourth node such that said transistor conducts said third current from said third current source to said fourth node, such that the temperature coefficient (TC) of the voltage at the output of said third current source tracks the TCs of the voltages at said first and second nodes.

13. The reference circuit of claim 8, wherein said first and second current sources comprise respective field-effect transistors (FETs) having their gates connected to the output of said differential amplifier and their source-drain circuits connected between said supply voltage and said first and second nodes, respectively, said FETs arranged to require a small source-to-drain difference voltage to operate, thereby permitting said supply voltage to approach a base-emitter voltage.

14. The reference circuit of claim 1, wherein said differential amplifier comprises:

third and fourth transistors having their control inputs connected to said first and second nodes, respectively, and one end of each of their current circuits connected together at a fourth node;

a first current mirror arranged to mirror an input current received at an input to said fourth node to provide a tail current for said differential amplifier;

a second current mirror connected to the other ends of said third and fourth transistors' current circuits to provide an active load for said differential amplifier, the output of said second current mirror being said amplifier's output.

15. The reference circuit of claim 14, wherein said first current mirror is referenced to said first circuit common point.

16. The reference circuit of claim 14, wherein said first current mirror is referenced to a reference potential which is different from the potential at said first circuit common point.

17. The reference circuit of claim 14, further comprising a fifth transistor having its control input connected to the output of said differential amplifier and its current circuit connected between a supply voltage and said first current mirror input such that said fifth transistor conducts said input current to said first current mirror.

18. The reference circuit of claim 17, wherein said first current mirror comprises an input field-effect transistor (FET) and an output FET, the sources of said FETs connected to a reference potential, the gates of said FETs connected together, and the drain of said output FET connected to said fourth node;

further comprising a third FET having its gate connected to said first node, its drain connected to said fifth transistor at a fifth node and its source connected to said first current mirror such that said third FET conducts said input current from said fifth transistor to said first current mirror, the common gates of said first current mirror transistors connected to said fifth node such that said third FET sets the drain voltage of said input FET approximately equal to the drain voltage of said output FET.

19. The reference circuit of claim 17, wherein said input current conducted by said fifth transistor is proportional to currents said first and second currents and thereby substantially temperature invariant, further comprising circuitry which employs said reference circuit as a series element to generate a constant current.

20. The reference circuit of claim 1, further comprising at least one switchable current source which can be selectively connected to said first node to adjust current said first current and thereby trim the ratio of said first and second currents.

21. The reference circuit of claim 20, wherein said first and second current sources comprise respective transistors having their control inputs connected to the output of said differential amplifier and their current circuits connected between a supply voltage and said first and second nodes, respectively, and wherein said at least one switchable current source comprises at least two switchable current sources, each of which comprises:

a current source transistor having its control input connected to the output of said differential amplifier and its current circuit connected between said supply voltage and an intermediate node, and a switching transistor having its current circuit connected between said intermediate node and said first node, which conducts current from said intermediate node to said first node in response to a trim control signal applied to its control input.

22. The reference circuit of claim 1, wherein said first and second circuit common points are the same point.

23. The reference circuit of claim 1, wherein said second circuit common point is a CMOS substrate.

24. A curvature corrected bandgap reference circuit, comprising:

first and second bipolar transistors having their bases and collectors coupled to first and second circuit common points, respectively;

first and second nodes;

third and fourth field-effect transistors (FETs) having their gates connected to a third node and their drain-source circuits connected between a supply voltage and said first and second nodes, respectively, said third and fourth FETs arranged to provide first and second currents I1 and I2 to said first and second nodes, respectively, the emitter of said first bipolar transistor coupled to said first node;

a differential amplifier connected to said first and second nodes at its inputs, the output of which is connected to said third node and arranged to control said third and fourth FETs such that the voltages at said first and second nodes are equal and said first and second currents are maintained in a fixed ratio;

a first resistor connected between said second node and a third node;

a second resistor connected between said third node and the emitter of said second bipolar transistor;

a third resistor connected between said second node and said first circuit common point;

said circuit arranged such that said first and second currents are substantially temperature invariant when the voltages at said first and second nodes are equal such that the signal across said second resistor includes a temperature proportional component and a residual component, wherein said residual component is of the form:

$$(kT/q)\ln((T_0-T_x)/(T-T_x)),$$

where $T_0$ is a normalizing measurement temperature and $T_x$ is the zero intercept of said temperature proportional component, said circuit arranged such that said residual component substantially compensates the base-emitter voltage curvature term present in the current in said third resistor.

25. The reference circuit of claim 24, further comprising:

a fifth FET having its gate connected to said third node and its drain-source circuit connected between said supply voltage and a fourth node, said fifth FET arranged to provide a third current I3 to said fourth node which tracks currents said first and second currents; and a load resistor connected between said fourth node and said first circuit common point, the voltage developed at said fourth node being said reference circuit's output voltage.

26. The reference circuit of claim 24, wherein said differential amplifier comprises:

fifth and sixth FETs having their gates connected to said first and second nodes, respectively, and their sources connected together at a fourth node;

a first current mirror comprising seventh and eighth FETs, the sources of which are connected to said first circuit common point and the gates of which are connected together, the drain of said eighth FET connected to said fourth node such that a current applied to the drain of said seventh FET is mirrored to said fourth node to provide a tail current for said differential amplifier;

a second current mirror connected to the drains of said third and fourth FETs to provide an active load for said differential amplifier, the output of said second current mirror being said amplifier's output;

a ninth FET having its gate connected to the output of said differential amplifier and its drain-source circuit connected between said supply voltage and a fifth node; and a tenth FET having its gate connected to said first node, its drain connected to said fifth node, and its source connected to the drain of said seventh FET such that said tenth FET conducts current from said ninth FET to said first current mirror, the common gates of said first current mirror FETs connected to said fifth node, such that said tenth FET sets the drain voltage of said seventh FET approximately equal to the drain voltage of said eighth FET.

27. The reference circuit of claim 24, further comprising at least one switchable current source which can be selectively connected to said first node to adjust current said first current and thereby trim the ratio of said first and second currents.

28. The reference circuit of claim 27, wherein said at least one switchable current source comprises at least two switchable current sources, each of which comprises:

a current source FET having its gate connected to the output of said differential amplifier and its drain-source circuit connected between said supply voltage and an intermediate node, and a switching FET having its drain-source circuit connected between said intermediate node and said first node which conducts current from said intermediate node to said first node in response to a trim control signal applied to its gate.

29. A curvature corrected bandgap reference circuit, comprising:

a first bipolar transistor operated such that it has a constant operating current and a base-emitter voltage $V_{be1}$; and a second bipolar transistor operated such that it has an operating current consisting of an approximately temperature proportional component and a non-linear component and a base-emitter voltage $V_{be2}$;

such that the ratio of the current densities in said first and second bipolar transistors varies with temperature and the difference voltage $\Delta V_{be}=V_{be1}-V_{be2}$ includes a residual component which approximately compensates bandgap curvature error.

30. The reference circuit of claim 29, wherein said difference voltage also includes a temperature proportional component and said residual component is of the form:

$$(kT/q)\ln((T_0-T_x)/(T-T_x)),$$

where $T_0$ is a normalizing measurement temperature and $T_x$ is the zero intercept of said temperature proportional component.

31. A method of generating a correction voltage which compensates bandgap curvature error, comprising:

operating a first bipolar transistor operated such that it has a constant operating current and a base-emitter voltage $V_{be1}$; and operating a second bipolar transistor such that it has an operating current consisting of an approximately temperature proportional component and a non-linear component, and a base-emitter voltage $V_{be2}$;

such that the ratio of the current densities in said first and second bipolar transistors varies with temperature and the difference voltage $\Delta V_{be}=V^{be1}-V^{be2}$ includes a component which approximately compensates bandgap curvature error.

32. The method of claim 31, wherein said difference voltage also includes a temperature proportional component and said residual component is of the form:

$$(kT/q)\ln((T_0-T_x)/(T-T_x)),$$

where $T_0$ is a normalizing measurement temperature and $T_x$ is the zero intercept of said temperature proportional component.

* * * * *